US007131263B1

(12) United States Patent
Styles

(10) Patent No.: US 7,131,263 B1
(45) Date of Patent: Nov. 7, 2006

(54) EXHAUST GAS RECIRCULATION COOLER CONTAMINANT REMOVAL METHOD AND SYSTEM

(75) Inventor: Daniel J. Styles, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/266,647

(22) Filed: Nov. 3, 2005

(51) Int. Cl.
*F02M 25/06* (2006.01)

(52) U.S. Cl. ..... 60/278; 60/274; 60/297; 60/298; 60/605.2; 123/568.12

(58) Field of Classification Search ..... 60/274, 60/278, 295, 297, 298, 605.2; 123/568.11, 123/568.12
See application file for complete search history.

(56) References Cited

U.S. PATENT DOCUMENTS

| | | | | |
|---|---|---|---|---|
| 3,412,722 | A * | 11/1968 | Epifanio, Sr. | 60/278 |
| 4,587,807 | A * | 5/1986 | Suzuki | 60/274 |
| 5,027,781 | A * | 7/1991 | Lewis | 123/568.11 |
| 5,390,492 | A * | 2/1995 | Levendis | 60/278 |
| 5,785,030 | A * | 7/1998 | Paas | 60/278 |
| 5,806,308 | A * | 9/1998 | Khair et al. | 60/278 |
| 6,301,887 | B1 * | 10/2001 | Gorel et al. | 60/605.2 |
| 6,360,532 | B1 * | 3/2002 | Strähle et al. | 60/321 |
| 6,367,256 | B1 | 4/2002 | McKee | |
| 6,427,436 | B1 * | 8/2002 | Allansson et al. | 60/274 |
| 6,474,060 | B1 | 11/2002 | Khair | |
| 6,598,388 | B1 * | 7/2003 | Lucas et al. | 60/311 |
| 6,612,293 | B1 | 9/2003 | Schweinzer et al. | |
| 6,647,971 | B1 * | 11/2003 | Vaughan et al. | 123/568.12 |
| 2004/0206342 | A1 | 10/2004 | Moyers et al. | |
| 2005/0056017 | A1 | 3/2005 | Sisken et al. | |

FOREIGN PATENT DOCUMENTS

| | | | |
|---|---|---|---|
| JP | 57-62392 | | 4/1982 |
| JP | 2002039019 | A * | 2/2002 |
| JP | 2002371921 | A * | 12/2002 |

* cited by examiner

*Primary Examiner*—Tu M. Nguyen
(74) *Attorney, Agent, or Firm*—Julia Voutyras; Richard M. Sharkansky

(57) ABSTRACT

Method and apparatus for removing contaminants from internal combustion engine exhaust gas recirculation cooler. The method feeds a portion of such exhaust gasses to an input end of an exhaust gas recirculation cooler with such gases flowing through the cooler to exit an output end of the cooler. The output end is at a lower elevation then the input end with gravitational forces being imparted to the contaminants. At least a portion of the contaminants exiting the cooler are collected in a trap. The exhaust gasses exiting the trap are returned to an intake manifold of the engine. Apparatus includes: a cooler for cooling the exhaust gasses having an input port for receiving a portion of such exhaust gasses and an output port for removing the cooled gasses; and a trap coupled to the output port for collecting particulates in the exhaust gasses passing to such trap from the cooler.

7 Claims, 2 Drawing Sheets

EXHAUST GAS RECIRCULATION COOLER CONTAMINANT REMOVAL METHOD AND SYSTEM

TECHNICAL FIELD

This invention relates generally to exhaust gas recirculation (EGR) systems and more particularly to methods and apparatus for trapping or collecting contaminants flowing through such EGR systems.

BACKGROUND

As is known in the art, Diesel Exhaust Gas Recirculation (EGR) coolers provide a cooled dilutent to lower combustion temperatures and reduce the concentrations of Oxides of Nitrogen in the exhaust gases. Such coolers typically include shell and tube heat exchangers using engine coolant. Due to the size of the EGR coolers, they must be packaged horizontally to fit into the engine compartment.

As is also known, diesel exhaust contains particulates and hydrocarbons, which together can adhere to the walls of the heat exchanger tubes of the cooler and thereby reduce the heat transfer performance of the cooler. This adhering behavior is made worse with lower gas temperatures leading to condensation of hydrocarbons and other exhaust constituents on the walls of the coolers which thereby collect more particulates. Due to new combustion and aftertreatment strategies to meet US Tier 2 emissions standards in diesel engines, there will also be even higher concentrations of Hydrocarbons with higher condensation temperatures that will worsen the adhering behavior. Researchers have proposed several basic forces which drive the contaminants to the walls including: 1) the temperature gradient across the tubes; 2) the pressure gradient created during condensation; 3) electrostatic forces; 4) inertial forces; 5) diffusion; and 6) gravity. The introduction of turbulence inducing ribs to improve heat transfer performance can make the fouling effect worse, making it desirable to further reduce the effects of hydrocarbon condensation and particulate deposition.

Another issue with current EGR subsystems is the packaging of sufficient 'mixing' length downstream from the point where the EGR gases enter the intake manifold. With the very high percentages of EGR required for future emissions standards, mixing lengths of 400 mm and longer may be required to achieve a homogeneous mix of EGR and fresh air. These long mixing lengths are difficult if not impossible to package and drive intake manifold designs that are disadvantageous for other important attributes such as volumetric efficiency, runner-to-runner flow balance, packaging, cost and weight.

SUMMARY

In accordance with the present invention, a method is provided for removing contaminants from internal combustion engine exhaust gas recirculation cooler. The method includes feeding recirculated exhaust gasses to an input end of an exhaust gas recirculation cooler with such gases flowing through the cooler to exit an output end of the cooler, the output end being at a lower elevation then the input end with gravitational forces being imparted to the condensated hydrocarbons and particulates; collecting at least a portion of contaminants exiting the cooler in a trap, or collector; and then returning the cooled exhaust gasses exiting the trap to an intake manifold of the engine.

With such method, the EGR cooler is disposed in a vertical orientation with the gas flow entering the top of the cooler and exiting the bottom instead of packaging in the normal horizontal position. This change in orientation eliminates gravity as a force driving the contaminants towards the tube walls and instead uses gravity to help move the condensates and particulates towards the end of the cooler, preventing them from settling on and fouling the heat exchanger walls. With the vertical orientation, the condensate runs down the tubes and into a collector, or trap, at the bottom of the cooler where they can be evaporated during high temperature operating conditions or during a specific purge cycle using the EGR cooler bypass functionality and entrained back into the main gas flow exiting the cooler. The vertical orientation eliminates the gravity effect of pushing the particulates towards the bottom of horizontally positioned walls. The vertical orientation of the EGR cooler thereby significantly reduces the concerns about EGR cooler fouling, especially in the presence of high Hydrocarbon concentrations. The EGR cooler(s) is positioned along side of the engine radiator where there is more likelihood for package space and synergies with the vehicle cooling module can exist. By packaging the EGR valve(s) (e.g., with the hot side position upstream of the EGR cooler) on the front of the exhaust manifold(s), the plumbing from the EGR valve to the EGR cooler have reasonable length. Due to the EGR cooler position next to the engine radiator and charge air cooler (CAC), if used, the cooled EGR gases can be merged with the cooled air flow leaving the charge air cooler significantly upstream of its normal entry point in the intake manifold, greatly increasing the mixing length for the EGR without resorting to non-optimal intake manifold designs. This enhanced EGR mixing length provides good homogeneous mixture or EGR and fresh air entering the cylinders. If necessary, the engine throttle can be moved upstream if it is used to generate more EGR flow so that the EGR can enter downstream of the throttle.

In accordance with another feature of the invention, apparatus is provided for removing contaminants from an internal combustion engine exhaust gas recirculation cooler. The apparatus includes a cooler for cooling the exhaust gasses. The cooler includes an input port for receiving a portion of such exhaust gasses and an output port for removing the cooled gasses. The apparatus includes a trap, or collector coupled to the output port for collecting contaminants in the exhaust gasses passing to such trap from the cooler.

In one embodiment the system includes a purging system for purging the contaminates from the trap.

In one embodiment, the trap is attached to the cooler.

In one embodiment the trap has a housing integral with a portion of a housing of the cooler.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
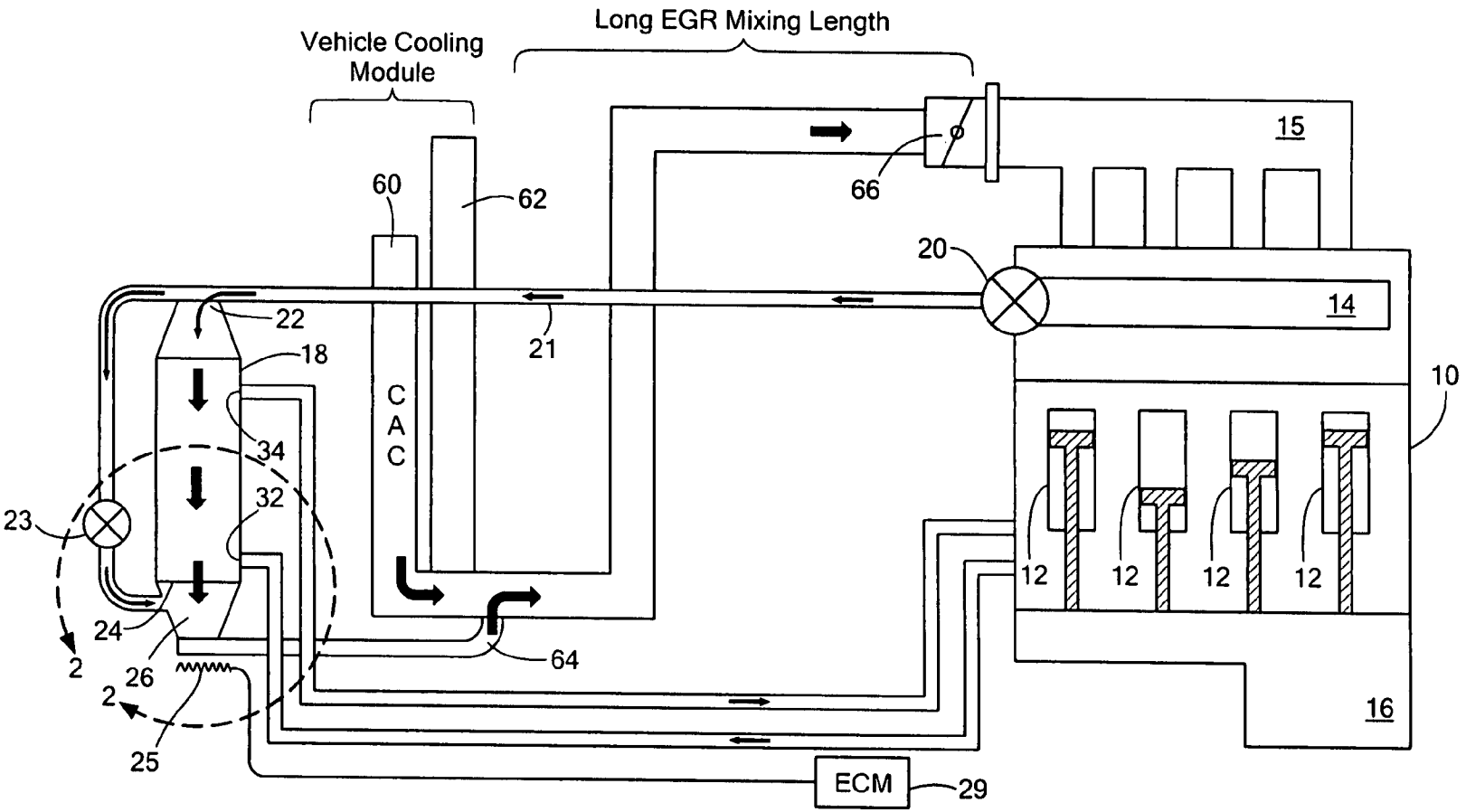
FIG. 1 is a diagrammatical sketch of an internal combustion engine having an exhaust gas recirculation (EGR) system and apparatus for trapping or collecting contaminants flowing through such EGR system according to the invention.
Figure 2:
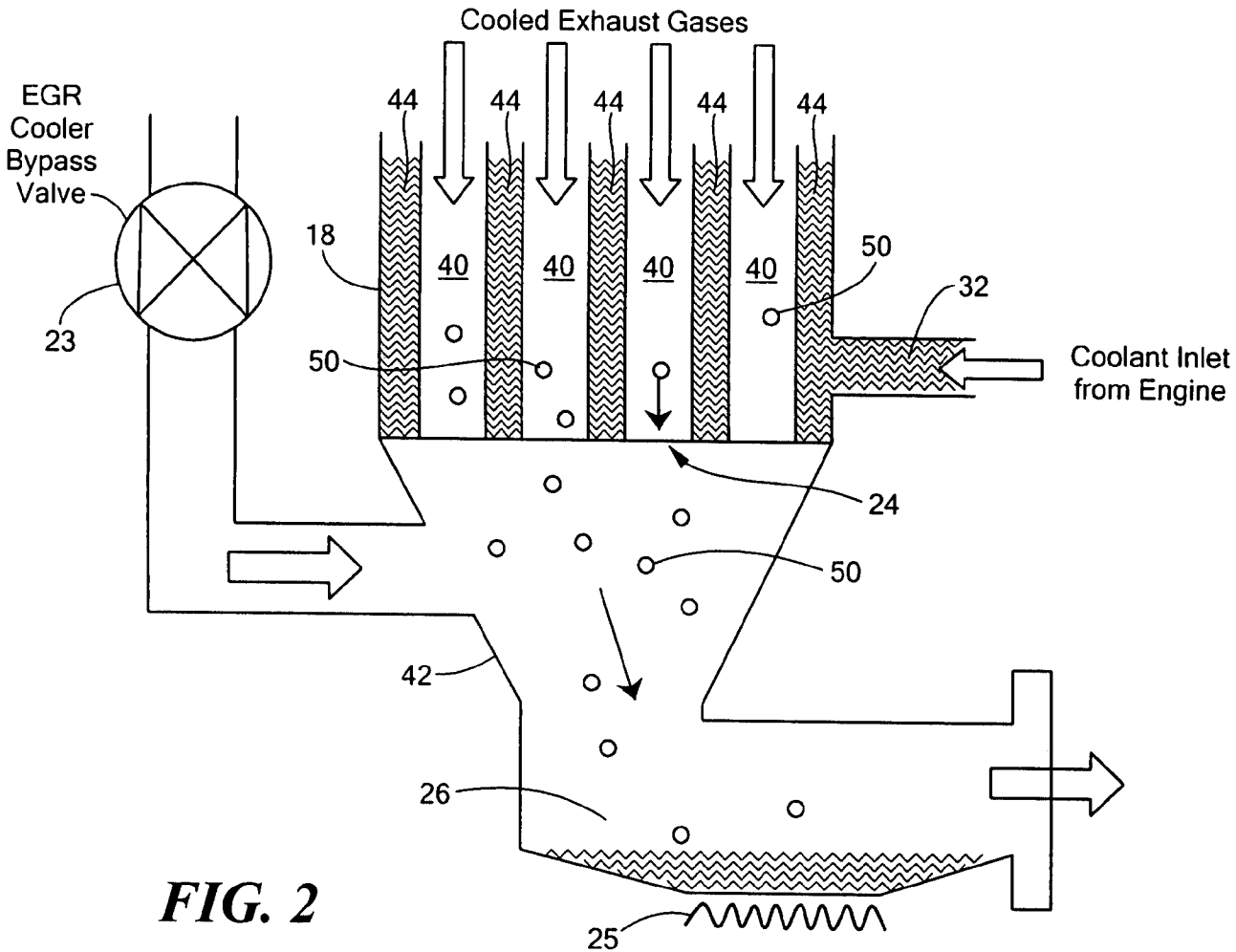
FIG. 2 is a diagrammatical sketch of an enlarged portion of the sketch of FIG. 1, such portion being enclosed by the arrow 2—2 of FIG. 1 according to the invention.

Referring now to FIGS. 1 and 2, an internal combustion engine 10 is shown having a plurality of cylinders 12, an exhaust gas manifold 14, an intake manifold 15, and a crankcase 16. A portion of hot exhaust gases is fed to an EGR cooler, or heat exchanger 18 through a conventional EGR valve 20, as shown.

The cooler 18 is provided for cooling the exhaust gasses. The cooler 18 includes an input port 22 for receiving a portion of such exhaust gasses passing through pipe 21 and an output port 24 for removing the cooled gasses. A trap 26, or collector, is coupled to the output port 24 for collecting contaminates in the exhaust gasses passing to such trap 26 from the cooler 18. The cooler 18 is mounted adjacent to the vehicle-cooling module including an charge air cooler 60 and radiator 62, as shown. The cooler 18 includes ports 32, 34 for receiving and exiting a coolant passing through the engine cooling system, directing the coolant through the shell 44 of the cooler as shown in FIG. 2. The trap 26 is attached to the bottom of the cooler 18, as shown. Here, the trap has a housing 42 (FIG. 2) integral with a portion of a housingcooler shell 44 of the cooler 18.

Here, an EGR cooler by-pass valve 23 is included and also receives exhaust gases from pipe 21 when such by-pass valve 23 is in the open position. The valve 23 is controlled by an engine control module (ECM) 29.

In operation, a portion of the exhaust gasses is fed through the EGR valve 20 to the input port 22 of the exhaust gas recirculation (EGR) cooler 18. The gases flow through the cooler tubes 40 and exit the output port 24. The output port 24 is disposed at a lower elevation then the input port 22 so that gravitational forces are imparted to the contaminants 50 (FIG. 2). At least a portion of the contaminants 50 exiting the cooler 18 are collected in the trap 26. The exhaust gasses exiting the trap are passed to the intake manifold 15 of the engine 10.

The contaminants including condensated hydrocarbons and particulates in the bottom of the trap 26 may be evaporated during high temperature operating conditions or during a specific purge cycle using the EGR cooler bypass functionality and entrained back into the main gas flow exiting the cooler 18. Here, the EGR cooler bypass valve 23 is normally used to aid "light off" of the engine catalytic converter, not shown, when the engine is first started by bypassing the EGR cooler 18 and sending hot gases into the intake manifold 15. These hot gases passing over top of the condensation trap 26 evaporate some of the condensates, thereby purging the trap 26. A heating element 25 below the trap 26 may also be used to evaporate the collected contaminants, if necessary. If used, the heating element 25 would be controlled by the engine control module (ECM) 29.

Here the engine 10 is a diesel engine having a conventional turbocharger, not shown, with air from an outlet of the compressor passing through a charge air cooler (CAC) 60. It is noted that with the cooler/trap apparatus shown in FIG. 1, there is sufficient mixing length between the point 64 (FIG. 1) where the gasses exit the trap 26 and mix with the compressed air and the point 66 where they enter the intake manifold 15, here such length being 400 mm or longer A number of embodiments of the invention have been described. Nevertheless, it will be understood that various modifications may be made without departing from the spirit and scope of the invention. Accordingly, other embodiments are within the scope of the following claims.

What is claimed is:

1. A method for removing contaminants from an internal combustion engine exhaust gas recirculation (EGR) cooler having a plurality of cooler tubes, comprising:

feeding a portion of recirculated exhaust gasses to input ends of the plurality of cooler tubes with such gases flowing through the cooler to exit output ends of the plurality of cooler tubes, the output ends being at a lower elevation than the input ends with gravitational forces being imparted to the contaminants;

collecting at least a portion of contaminants exiting the cooler tubes in a trap; and receiving air from a charge air cooler;

mixing the recirculated exhaust gases from the output ends of the EGR cooler tubes with the air received from the charge air cooler; and returning the recirculated exhaust gasses exiting the trap along with the received air therewith to an intake manifold of the engine.

2. Apparatus for removing contaminants from internal combustion engine exhaust gas recirculation cooler, comprising:

a cooler for cooling recirculated exhaust gasses, comprising:

a plurality of cooler tubes, each one of the tubes having:

an input port for receiving a portion of such recirculated exhaust gasses; and an output port for removing the cooled recirculated gasses;

wherein the input port is at a higher elevation than the output port;

a charge air cooler providing at an output thereof air from an outlet of a turbocharger compressor;

a conduit for mixing the recirculated exhaust gasses from the output port with the air received from the charge air cooler.

3. Apparatus for removing contaminants from internal combustion engine exhaust gas recirculation cooler, comprising:

a cooler for cooling recirculated exhaust gasses, comprising:

a plurality of cooler tubes, each one of the tubes having:

an input port for receiving a portion of such recirculated exhaust gasses; and an output port for removing the cooled recirculated exhaust gasses;

wherein the input port is at a higher elevation than the output port;

an charge air cooler providing at an output thereof air from an outlet of a turbocharger compressor;

a conduit for mixing the recirculated exhaust gasses from the output port with the air received from the charge air cooler; and a trap coupled to the output port for collecting contaminants in the recirculated exhaust gasses passing to such trap from the cooler.

4. The apparatus recited in claim 3 including a purging system for purging the contaminants from the trap.

5. The apparatus recited in claim 4 wherein the purging system comprises: a heating element disposed below the trap.

6. The apparatus recited in claim 4 wherein the trap is attached to the cooler.

7. The apparatus recited in claim 6 wherein the trap has a housing integral with a portion of a housing of the cooler.

* * * * *